US006974074B1

(12) United States Patent
Watts

(10) Patent No.: US 6,974,074 B1
(45) Date of Patent: Dec. 13, 2005

(54) ANTI-THEFT MAILBOX INSERT

(76) Inventor: Keith Peter Watts, 2641 Palos Verdes Dr., North, Rolling Hills Estate, CA (US) 90274

( * ) Notice: Subject to any disclaimer, the term of this patent is extended or adjusted under 35 U.S.C. 154(b) by 0 days.

(21) Appl. No.: 10/863,014

(22) Filed: Jun. 8, 2004

(51) Int. Cl.[7] ..... B65G 11/04
(52) U.S. Cl. ..... 232/45; 232/29
(58) Field of Search ..... 232/45, 47, 17, 232/29, 33

(56) References Cited

U.S. PATENT DOCUMENTS 4,361,271 A * 11/1982 Hester et al. ..... 232/17
4,724,999 A * 2/1988 Fitzgerald et al. ..... 232/17
5,143,284 A * 9/1992 Socarras ..... 232/21
5,351,883 A * 10/1994 Pachl ..... 232/17
5,915,618 A * 6/1999 Gaudet ..... 232/33
6,722,561 B1 * 4/2004 Thomas et al. ..... 232/39
2004/0238615 A1 * 12/2004 Offenbacher ..... 232/29

* cited by examiner

*Primary Examiner*—William L. Miller

(57) ABSTRACT

An anti-theft mailbox insert installed inside of a petestal mail box for limiting access to delieverd mail. The insert has a horizontal shelf located just below the mailbox mail slot. When mail is inserted into the mailbox slot it falls to the bottom of the mailbox and the anti-theft mailbox insert prevents a person's hand from reaching in through the mailbox slot and stealing the mail. The mail can be retrieved using the locking rear door of the mailbox.

4 Claims, 2 Drawing Sheets

ANTI-THEFT MAILBOX INSERT

BACKGROUND OF THE INVENTION

1. Field of the Invention

The present invention relates generally to mail boxes. More specifically, the invention is a device which is placed within a pedestal mail box for limiting access to delivered mail.

2. Description of the Related Art

People are often faced with the problem of someone stealing their mail for a variety of reasons. The prior art devices that try to remedy this situation do so by creating deep bins for keeping mail out of reach of potential thieves. In those inventions, the mail is generally retrieved by opening an access panel near the bottom of the mailbox, causing the recipient to have to bend down close to the ground to retrieve his mail. A pedestal mailbox provides some measure of mail theft prevention with a hinged mail slot and a lockable rear access door, but a theif can reach in through the mail slot and steal the mail.

U.S. Pat. No. 308,148 issued on Mar. 27, 1888 to Thompson discloses a mailbox with a supplemental compartment disposed on top of a standard mailbox for receiving large materials such as periodicals and small parcels.

U.S. Pat. No. 481,621 issued on Aug. 30, 1892 to Light discloses a mailbox with multiple receipt compartments and an outgoing mail slot. The box has lockable doors at both ends and there are several slidable drawers which can be removed by post office personnel. There are individual doors on the opposite end corresponding to each drawer which can ve accessed by the individual key holder.

U.S. Pat. No. 4,993,626 issued on Feb. 19, 1991 to Berry discloses a mailbox designed for storage of mail in a secure lower portion of the housing. The mailbox has a swingable mail shelf to divide the housing into upper and lower compartments with the mnail shelf being moved from a substantially horizontal mail rest position to a downwardly inclined mail dunpo position. The device in Berry utilizes the deptjh of the mailbox to prevent others from taking mail from the box and can not be susessfully adapted for use with standard mailboxes.

U.S. Pat. No. 4,600,143 issued on Jul. 15, 1986 to Harlow, Jr. et al. discloses a standard mailbox with a slidable tray that can be removed from the mailbox to make mail retrieval easier for the recipient and the postal employee. The patent to Harlow, Jr. et al. coes not disclose any mean of securing the mail within the mailbox.

U.S. Pat. No. 4,724,999 issued on Feb. 16, 1988 to Fitzgerald et al. discloses a mailbox with two compartments: an unsecured upper compartment and a secure, locked lower compartment, with a partition there between. The angle that the partition creates is great enough to prevent others from gaining access to the incoming mail. The upper unlocked portion is generally for outgoing correspondence. The patent to Fitzgerald et al. is effective as a security device due only to the depth of the mailbox itself and is not adaptable for use in a conventional mailbox as in the present invention.

U.S. Pat. No. 5,351,883 issued on Oct. 4, 1994 to Pachl discloses a mail access section sufficiently dimensioned for receiving and supporting letters and packages for pickup and delivery. The box is shaped as an upside down L. The mailbox is effective as a security device because of its dimension and is not adaptable for use with a conventional mailbox.

U.S. Pat. No. 5,915,618 issued on Jun. 29, 1999 to Gaudet discloses a lockable mailbox that is secured inside of a conventional mailbox.

French Patent No. 2,345,973 published in December 1977 discloses a lockable letter box. The letter box in the French patent does not teach the use of the letter box within a standard mailbox.

Other patents which have addressed mailbox security, but are less relevant than the above patents are German Patent No. DE 2,908,073 published on Sep. 4, 1980 and Great Britain Patent No. 1,008,982 published on Nov. 3, 1965.

None of the above inventions and patents, taken either singularly or in combination, is seen to describe the instant invention as claimed. Thus an anti-theft mailbox insert solving the aforementioned problems is desired.

SUMMARY OF INVENTION

The present invention is an anti-theft mailbox insert placed within a pedestal style mailbox for limiting access to delivered mail. The insert is comprised of two walls and an interconnecting shelf that forms an "H" shaped structure. The interconnecting shelf of the insert is dimensioned in height so that it prevents a hand from reaching in the mailbox slot and tampering with the mail. The sides of the mailbox insert are dimensioned in height and width to prevent the insert from being pushed back or up thus defeating the function of the interconnecting shelf.

Accordingly, it is a principal object of the invention to provide an insert for a conventional pedestal style mailbox that increases security against mail tampering.

It is another object of the invention to provide an insert for a conventional pedestal style mailbox for security purposes that is functional yet ergonomic for the mail recipient to use.

It is an object of the invention to provide improved elements and arrangements thereof for the purposes described which is inexpensive, dependable and fully effective in accomplishing its intended purposes.

These and other objects of the present invention will become readily apparent upon further review of the the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
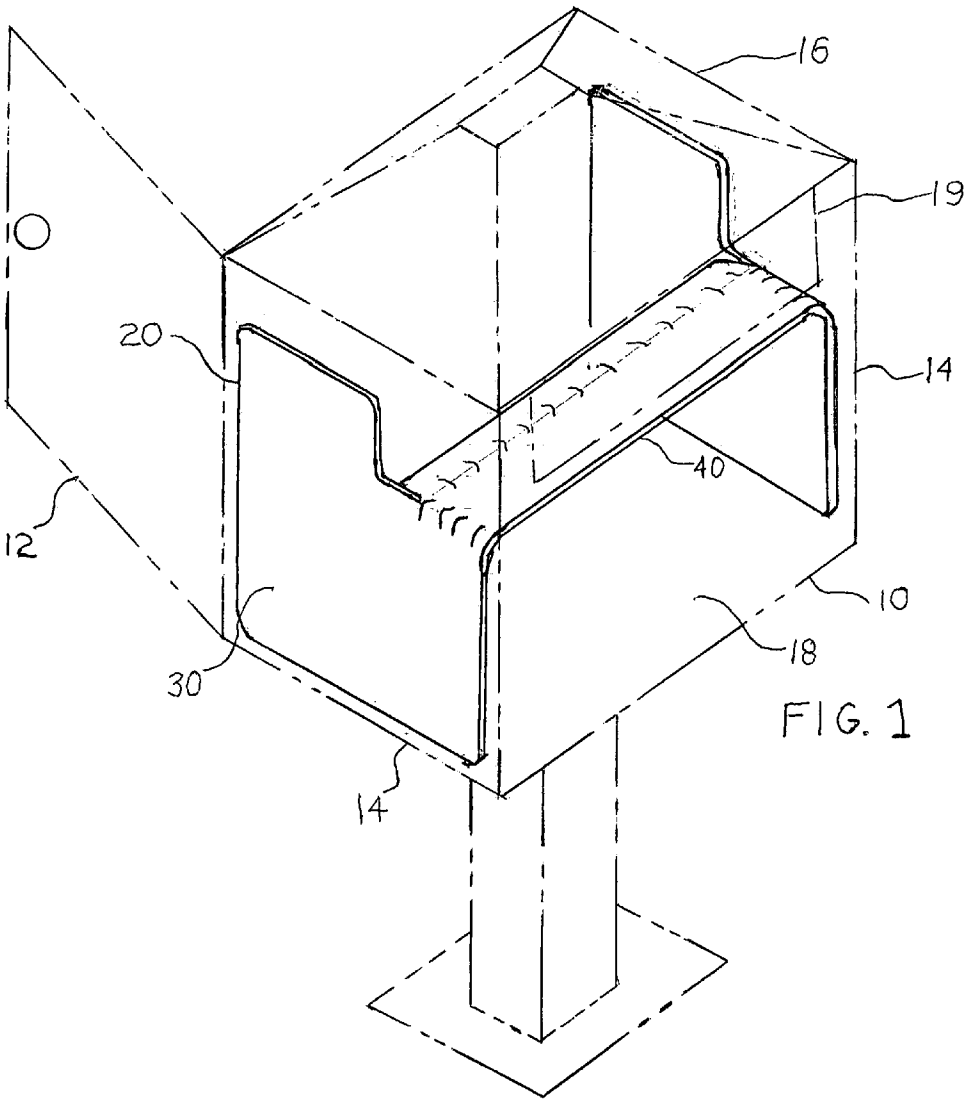
FIG. 1 is an environmental isometric view of an anti-theft mailbox insert in its intended orientation within a pedestal style mailbox according to the present invention.
Figure 2:
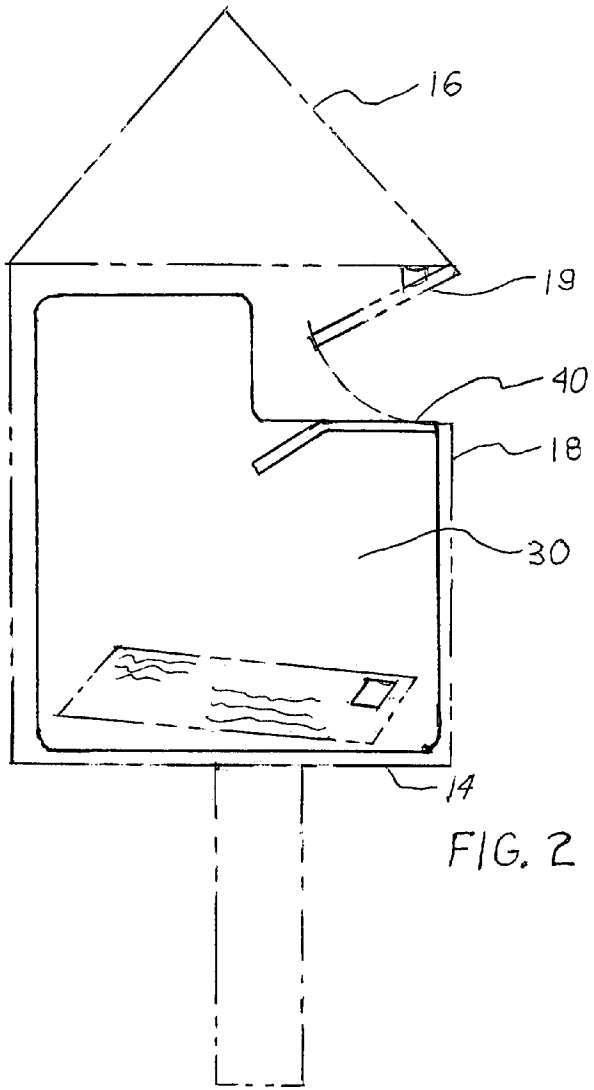
FIG. 2 is a side view of an anti-theft mailbox insert with one side removed for clarity. It shows the position of the interconnecting shelf in relation to the mailbox opening according to the present invention.

The present invention is an anti-theft mailbox insert 20 which is used inside of a pedestal mailbox 10. The mailbox 10 has back door 12 and a front wall 18 opposite said back door 12. The mailbox also has two side walls 14 and a roof 16, generally forming a vaulted cavity into which the insert 20 can be slidably inserted into. The mailbox 10 further includes a door 19 pivotally attached by its top edge.

The insert 20 is constructed from a high strength material such as aluminum, steel or a stiff plastic.

As seen in the Figures the insert is an 'H' shaped structure defined by two walls 30 and an interconnecting shelf 40 which is positioned just below the bottom of the mailbox slot. The rear edge of the interconnecting shelf 40 is bent down approximately 30 degres. The insert sides 30 are slightly smaller than the mailbox 10 sides 14 to prevent the insert from being lifted or pushed back, thus defeating the function of the interconnecting shelf 40. The insert 20 is sized such that it can be installed through the rear door 12 of the mailbox 10 without the need for any tools.

It is understood that the present invention is not limited to the embodiments described above, but encompasses any and all embodiments within the scope of the following claims.

I claim:

1. An anti-theft mailbox insert in combination with a pedestal mailbox, said mailbox defining an interior cavity and including a back door, a front wall with a mail slot opposite said back door, a top and side walls; said anti-theft insert for slidably installing within said mailbox and comprising a pair of vertically extending side walls with an interconnecting shelf extending horizontally therebetween a rear edge of said shelf being bent downwardly; wherein when said back door is in a closed position, said interconnecting shelf is just below the mail slot and forms a barrier to prohibit access to mail placed inside of the mailbox; and wherein when said back door is in an open position, access is provided to the mail located inside of the mailbox.

2. The combination of claim 1, wherein said insert is constructed from a high strength material.

3. The combination of claim 1, wherein said insert is of such a size to prevent it from being pushed back or up when installed within said mailbox.

4. The combination of claim 1, wherein said insert can be installed into said pedestal mailbox through the back door without the need of any tools.

* * * * *